US011098995B2

(12) United States Patent
Sturm

(10) Patent No.: US 11,098,995 B2
(45) Date of Patent: Aug. 24, 2021

(54) IGNITION DEVICE WITH A COMPACT DESIGN

(71) Applicant: Fr. Sobbe GmbH, Dortmund (DE)

(72) Inventor: Joachim Sturm, Lohmar (DE)

(73) Assignee: Fr. Sobbe GmbH, Dortmund (DE)

( * ) Notice: Subject to any disclaimer, the term of this patent is extended or adjusted under 35 U.S.C. 154(b) by 0 days.

(21) Appl. No.: 16/497,955

(22) PCT Filed: Apr. 4, 2018

(86) PCT No.: PCT/DE2018/100298
§ 371 (c)(1),
(2) Date: Sep. 26, 2019

(87) PCT Pub. No.: WO2018/188690
PCT Pub. Date: Oct. 18, 2018

(65) Prior Publication Data

US 2020/0025544 A1 Jan. 23, 2020

(30) Foreign Application Priority Data

Apr. 13, 2017 (DE) ..... 20 2017 102 257.9

(51) Int. Cl.
*F42D 1/04* (2006.01)
*F42B 39/30* (2006.01)

(52) U.S. Cl.
CPC ..... *F42D 1/043* (2013.01); *F42B 39/30* (2013.01); *F42D 1/04* (2013.01)

(58) Field of Classification Search
CPC .... F42B 3/00; F42B 3/02; F42B 39/30; F42D 1/02; F42D 1/04; F42D 1/043; F42D 5/04
See application file for complete search history.

(56) References Cited

U.S. PATENT DOCUMENTS 1,366,623 A * 1/1921 Woodberry ..... F42B 30/04 244/3.3
1,483,209 A * 2/1924 Bills ..... F42B 3/00 102/326
1,631,756 A * 6/1927 Olin ..... F42B 39/30 102/202.12
1,698,962 A * 1/1929 Olin ..... F42B 39/30 102/202.12
1,929,911 A * 10/1933 Barab ..... F42B 39/30 102/202.12

(Continued)

FOREIGN PATENT DOCUMENTS

DE 1771851 B1 2/1972
DE 2927174 A1 2/1980

(Continued)

*Primary Examiner* — Derrick R Morgan
(74) *Attorney, Agent, or Firm* — James Creighton Wray

(57) ABSTRACT

An ignition device (1) for military or police used having a mechanical trigger (2), a shock tube (3) of variable length, blasting cap (4), whereby the blasting cap (4) with the trigger (2) and the shock tube (3) are accommodated in a protective pipe (8) sealed at both ends by means of sealing discs (13) or end plates (10). The shock tube (3) surrounds the trigger (2) and blasting cap (4) and so can be easily pulled out of the protective pipe (8) after the locking device (16, 52) is released. The protective pipe (8) is enclosed in a shrink sleeve (34), as is the shock tube (3), so that the system is suitable for underwater use as well.

13 Claims, 4 Drawing Sheets

(56) References Cited

U.S. PATENT DOCUMENTS 2,062,189 A * 11/1936 Olin ..... F42B 39/30 102/202.12
2,179,052 A * 11/1939 Nelms ..... F42D 1/04 429/8
2,300,225 A * 10/1942 Johnson ..... F42B 39/30 102/202.12
2,674,945 A * 4/1954 Marsh ..... F42B 39/30 102/202.12
2,717,551 A * 9/1955 Blackburn ..... F42B 39/30 102/202.1
2,823,610 A * 2/1958 Frazer ..... F42B 39/30 102/202.12
2,876,701 A * 3/1959 Long ..... F42D 1/04 102/272
3,008,411 A * 11/1961 Conrad ..... F42D 1/04 175/4.56
3,112,699 A * 12/1963 Noddin ..... F42D 1/04 181/123
3,112,703 A * 12/1963 Urdapilleta ..... F42C 15/23 102/487
3,129,663 A * 4/1964 Schnepfe, Jr. ..... F42D 1/043 102/275.4
3,180,261 A * 4/1965 Moore ..... F42D 1/04 102/262
3,260,206 A * 7/1966 Beermann ..... F42C 7/12 102/261
3,401,631 A * 9/1968 Hannagan ..... B26F 3/04 89/1.14
3,792,660 A * 2/1974 Plumer ..... F42D 1/04 102/275.5
3,878,786 A * 4/1975 Ridgeway ..... F42B 39/30 102/202.11
4,023,494 A * 5/1977 Barton ..... F42B 3/00 102/314
4,266,613 A * 5/1981 Boop ..... F42D 1/04 166/299
4,372,214 A * 2/1983 Toton ..... F42B 1/00 102/305
4,512,418 A * 4/1985 Regalbuto ..... E21B 43/116 175/4.56
4,527,482 A * 7/1985 Hynes ..... F42D 1/04 102/275.2
4,648,470 A * 3/1987 Gambertoglio ..... E21B 43/116 166/55.1
4,776,275 A * 10/1988 Holzinger ..... C06C 5/06 102/202.3
4,920,883 A * 5/1990 Barker ..... F42D 1/04 102/202.5
4,998,477 A * 3/1991 Barker ..... F42D 1/04 102/202.5
5,070,788 A * 12/1991 Carisella ..... E21B 43/116 102/202.1
5,115,865 A * 5/1992 Carisella ..... F42D 1/04 166/297
5,159,145 A * 10/1992 Carisella ..... E21B 43/1185 102/222
5,365,851 A * 11/1994 Shaw ..... F42D 1/04 102/275.11
5,392,860 A * 2/1995 Ross ..... E21B 23/065 102/222
5,483,895 A * 1/1996 Tomek ..... E21B 43/11852 102/251
6,006,671 A * 12/1999 Yunan ..... C06C 5/04 102/275.1
6,272,996 B1 * 8/2001 O'Brien ..... C06C 5/06 102/275.1
6,581,519 B1 * 6/2003 Adams ..... C06C 5/06 102/275.11
7,066,320 B2 * 6/2006 Sansolo ..... F42B 39/14 206/3
7,451,700 B1 * 11/2008 Land ..... F42D 1/04 102/209
10,393,489 B1 * 8/2019 Burmeister ..... F41H 11/28
2003/0110970 A1 * 6/2003 Sansolo ..... B65H 75/364 102/200
2003/0140773 A1 * 7/2003 Porter ..... F42B 12/365 89/1.11
2005/0126418 A1 * 6/2005 Lynch ..... F42D 1/04 102/275.11
2005/0242093 A1 * 11/2005 Sharpe ..... B65D 90/325 220/62.11
2006/0108237 A1 * 5/2006 Sansolo ..... F42B 39/14 206/3
2006/0144279 A1 * 7/2006 Bawabe ..... F42B 39/30 102/275.12
2008/0083342 A1 * 4/2008 Munoz Saldarriaga ..... F42B 39/14 102/202.1
2008/0245253 A1 * 10/2008 Lynch ..... F42D 1/04 102/275.11
2010/0000789 A1 * 1/2010 Barton ..... E21B 43/11852 175/2
2010/0024674 A1 * 2/2010 Peeters ..... F42D 1/043 102/275.4
2010/0212480 A1 * 8/2010 Bell ..... F42B 3/26 89/1.15
2013/0277108 A1 * 10/2013 Greeley ..... F42D 1/043 175/2
2018/0038209 A1 * 2/2018 Coffey ..... E21B 43/11852
2019/0249970 A1 * 8/2019 Wilson ..... F42C 15/32
2020/0025544 A1 * 1/2020 Sturm ..... F42B 39/30

FOREIGN PATENT DOCUMENTS

DE 3025703 A1 2/1981
DE 19546823 A1 6/1997
DE 102013005631 A1 10/2014
GB 2502324 A 11/2013

* cited by examiner

IGNITION DEVICE WITH A COMPACT DESIGN

This application claims the benefit of German Application No. 20 2017 102 257.9 filed Apr. 13, 2017 and PCT/DE2018/100298 filed Apr. 4, 2018, International Publication No. WO 2018/188690 A1, which are hereby incorporated by reference in their entirety as if fully set forth herein.

The invention concerns an ignition device consisting of a mechanical trigger, a thermo or shock tube of variable length and a blasting cap for military or police use.

Such ignition devices are used as aids in blasting and pyrotechnics that are required to trigger blasting. They provide the necessary energy for the chemical reaction of the explosive substances. In the present development, the ignition device includes the mechanical trigger as well as a detonating cord, also referred to as a thermo or shock tube, and the appropriate blasting cap, which is initiated by the trigger. A trigger is familiar from DE 10 2013 005 631 A1 in which a movable firing pin can be pre-loaded by hand, in order then to impact a primer, which is connected to the shock tube, when the firing pin is relaxed. Such shock tube or safety fuses as well are usually formed by a plastic tube with a single or multiple walls, into which an explosive is inserted loosely in thread form or as internal surface coating. Tubes of this type are familiar, for example, from DE 30 25 703 C2, DE 17 71 851 B, DE 195 46 823 C2 or DE 29 27 174 C2. They can be used in practically any length, whereby they require special handling because of their structure and contents. It is therefore a certain disadvantage that shock tubes are used with the familiar ignition devices that are initially transported as rolls with the end blasting cap and then have to be unrolled and in certain circumstances diverted at the location of use. In the cases of planned military or police use, safety is particularly in demand during use, and in the case of ignition devices consisting of trigger, shock tube and blasting cap can usually only be satisfied with great effort. If the shock tube is bent, this can lead to misfirings or to no ignition process.

The invention is therefore based on the task of creating a compact ignition device that is designed to favour fast reaction and simple and safe unrolling of the tube.

The task is solved in accordance with the invention in that the blasting cap, which is designed to fit a great number of explosive charges, is arranged together with the trigger and the tube in a protective pipe having a front end with end plates fixing the trigger and having a rear end with an end disc fixing the blasting cap and the tube end, whereby the tube is located in the protective pipe encircling the trigger and blasting cap and is arranged and designed to be removable with the blasting cap from the protective pipe. With an ignition device of this type it is possible to store the trigger and the blasting cap together with the shock tube in any length as a compact unit and to use it for military and police operational purposes. A protective pipe of suitable length serves as the receiving safety unit, into which, on the one side, the trigger and, on the other side, the blasting cap is held securely, while the shock tube of any length is stored rolled up in the protective pipe. This design not only has the advantage that a protective pipe mainly of a round design enables safe transport and storage, but also that it enables fast reaction at the location of use, because the tube can be simply pulled out of the protective pipe and placed and arranged with the blasting cap at the end in such a way that no danger whatsoever occurs for the task forces themselves. It is particularly advantageous here that the tube only has to be pulled out of the tube just to the extent that is necessary for the application. This means that there are no unnecessary loops or similar that can only hinder the application. Above all, the risk of the tube buckling is practically ruled out.

In an expedient implementation it is provided that the blasting cap is positioned packed in the protective pipe in a fragmentation protection sleeve, which is designed to satisfy transport class 1,4S. Apart from the fact that this fragmentation protection can be designed so that it is advantageous for the safe storage of the blasting cap, through this design of the blasting cap transport of the complete system is possible without special safety requirements.

In order to be able where required to accommodate a large number of coils in the protective pipe it is an advantage if the fragmentation protection sleeve is designed sturdily enough to take the tube's coils.

In order to be able to unroll and accommodate the tube safely not only in the area of the fragmentation protection sleeve but also in the area of the trigger, the invention provides that the protective pipe has an inner pipe that holds the tube's coils, whereby the tube is covered towards the internal wall of the protective pipe by a shrink sleeve. Therefore, the tube is not only supported securely on this inner pipe, or on the fragmentation protection sleeve respectively, but it is also secured with regard to its support by the shrink sleeve, which is attached and designed in such a way that pulling out together with the blasting cap and/or trigger is not impaired.

A further invention provides that the inner pipe is fitted with discs at the ends that secure the position of the tube coils. These discs are on the one hand advantageous for securing the tube in the protective pipe and on the other for pulling out together with the blasting cap and/or trigger together. These discs are correspondingly high above the inner pipe, so that, as already referred to several time, several layers of shock tube—coils are possible.

It was mentioned several times that the trigger is to be pulled out of the protective pipe together with the tube. In order to enable this as a unit it is provided that the protective pipe has a lid with an opening for the trigger at the front end and at the rear end a sealing ring with an opening that is shaped to be advantageous for inserting the inner pipe with coils or for pulling it out. At the front end the trigger is supported securely through the suitable widely designed lid and can be inserted without problems deep into the protective pipe or pulled out of it, if, for example, it is intended to actuate the trigger.

To stabilise and transport the ignition device safely it is expedient if the complete protective pipe is designed surrounded completely by a shrink sleeve. A shrink sleeve of this type encloses above all the corner areas and enables information sheets or similar to be attached between the outer wall of the protective pipe and the inner wall of the shrink sleeve.

In a further optimisation it is provided that the two ends of the protective pipe are sealed with the sealing ring or lid designed as a plastic disc and a cover, which are fixed in addition by the shrink sleeve. The design as a plastic disc reinforces both the stable and secure mounting of both the trigger and of the blasting cap.

Because of the additional security provided by the shrink film and the whole system, the protective pipe can be designed advantageously as a thin-walled sleeve with fixing covers, whereby the covers are shaped to hold the lid at the front end and the sealing ring at the rear end securely.

A further expedient embodiment provides that the trigger has a design that is advantageous for insertion and secure storage in the protective pipe. It is an advantage here if it has a type of pencil shape, in particular if the opening for the trigger in the lid e.g. has a limited flexible external surface. Inserting and pulling out are facilitated in this way, whereby the coating serves at the same time as a braking and security layer for the trigger.

In accordance with one embodiment of the invention, identifiers showing the length of the inside shock tube are attached between the outside of the shock tube and the inside of the shrink film, which consists of transparent material. In this way, the operator using the ignition device can detect easily and clearly whether the ignition device or the tube is suitable for the respective application.

As a further improvement to the design of the fragmentation protection it is provided that the fragmentation protection sleeve is designed as connection bushing. In this way, the blasting cap and the corresponding connection parts are placed in a securing bushing, so that the transport class is clearly reduced from 1.1 B to 1.4 S. This means that transport of the systems is possible without special requirements, whereby in accordance with a further expedient embodiment the bushing is designed to envelop the blasting cap completely, that is, it is circular and, as taught in claim 3, supports the coils of the tube.

Finally, the invention provides that the connection bushing is dimensioned to hold a second blasting cap as well. The first shock tube or thermotube is initiated through the initiation of the second system and the blasting cap is ignited on the object.

The invention is characterised in particular in that an ignition device is created that be transported and stored easily as a compact unit and that enables fast reacting, in particular because shock tube and blasting cap can be removed easily from the protective pipe and brought to the deployment site without endangering the operatives in any way.

Further details and advantages of the subject-matter of the invention can be seen in the following description of the associated drawing, in which a preferred embodiment is shown with the details and components required for this:

DETAILED DESCRIPTION

Figure 1:
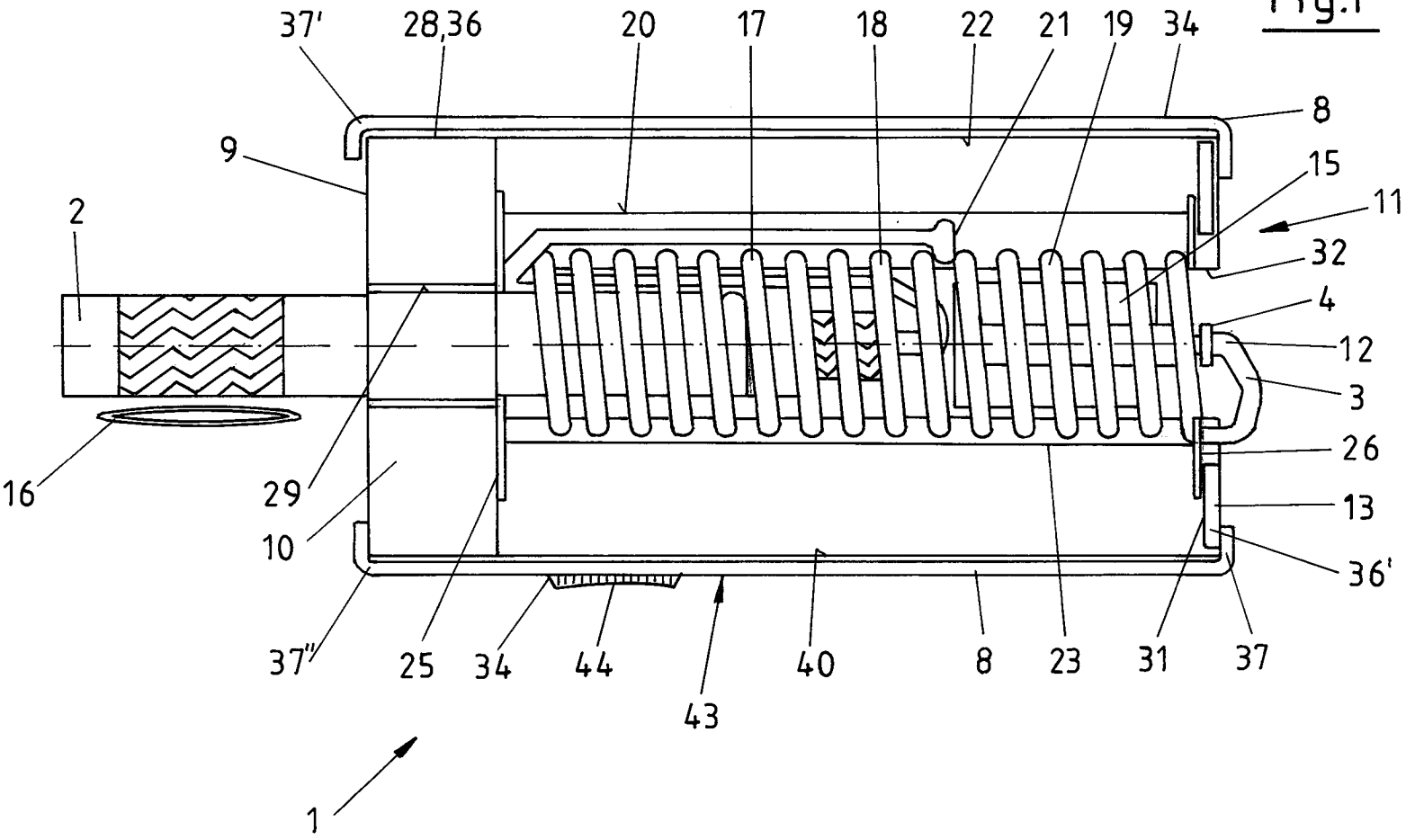
FIG. 1 shows an ignition device comprising a compact unit.
Figure 4:
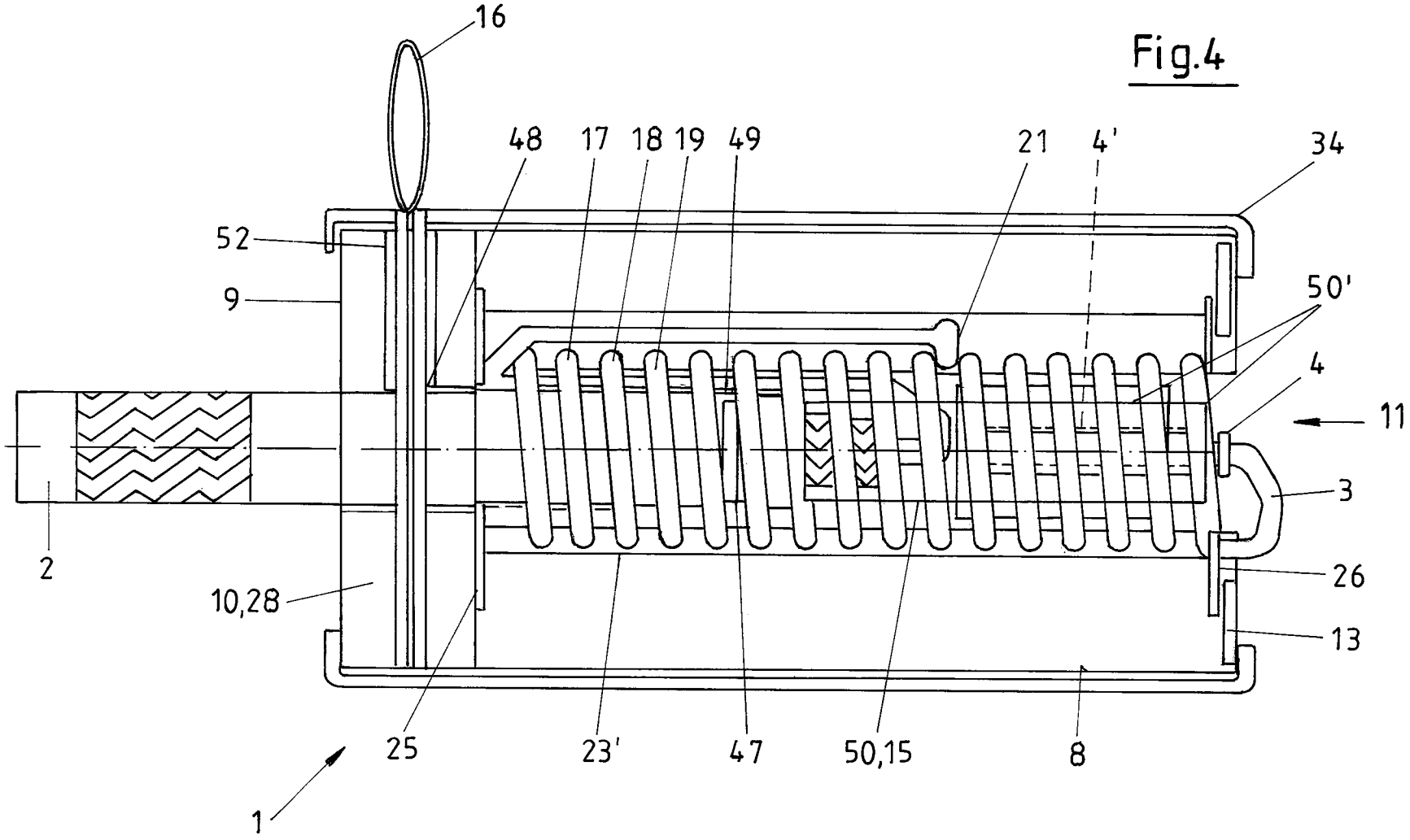
FIG. 4 shows a further design for an ignition device.

The ignition device 1 shown in FIG. 1 is a special design of the familiar EBBOS single-hand igniter. This ignition device 1 consists of the trigger 2, the tube 3 and the blasting cap 4, which are all accommodated in a protective pipe 8 that secures them. The trigger 2 is a mechanical trigger, that was developed for military or police use in the non-electric ignition system. There is a relatively thick end plate 10 at the front end 9 of the protective pipe 8, so that the trigger 2 is supported securely. The single-hand igniter handle not shown here can be easily unlocked using the retaining ring 16. FIG. 4 shows an additional retaining pin 52.

The blasting cap 4, which is connected with the tube end 12, is located at the rear end 11 of the protective pipe 8. A sufficiently stable sealing disc 13 ensures that both tube end 12 and the blasting cap 4 are safely supported inside the protective pipe 8. The sealing disc 13 has an opening 32 for the components that are stored in the protective pipe. These components, i.e. of tube 3 has a great number of coils 17, 18, 19, inside the protective pipe 8 so that it has the desired variable length, which is made use of in that the blasting cap 4 together with the tube 3 is drawn out of the protective pipe 8 as far as is required for the respective operation. The blasting cap 4 is packed in a fragmentation protection sleeve 15 in order to reduce the transport class from 1.1B to 1.4S. In this way, transport of the systems is facilitated without special requirements.

The secure generation of the coils 17, 18, 19 is guaranteed by an inner pipe 20, onto which tube 3 is rolled and secured in addition by means of a shrink sleeve 23. The shrink sleeve 23 is applied in the direction of the inner wall 22 of the protective pipe 8, whereby if additional coils 21 are applied, the shrink sleeve 23 naturally covers these as well.

The described unit consisting of blasting cap 4 and coiled tube 3 can be slid into protective pipe 8 as a unit, because there are discs 25, 26 at the ends that make possible the secure support of tube 3 on the inner pipe 20 or a similar auxiliary device.

In the design shown in FIG. 1 the end plate 10 consists of a plastic disc 36, which to a certain extent functions as lid 28 and enables the required secure support for the trigger 2. As shown in FIG. 1 it is relatively thick.

The unit consisting of the trigger 2, tube 3 and blasting cap 4 is fixed in the protective pipe 8 as mentioned by the lid 28 and on the other hand by a sealing ring 31. This sealing ring 31 is also designed as a plastic disc 36' and has an opening 32 that secures the insertion and extraction of blasting cap 4 and tube 3 together with disc 26. This sealing ring 31 can have a certain degree of flexibility, in order to facilitate the removal of blasting cap 4 and tube 3 as a unit.

Lid 28 also has an opening 29 through which the secure support of the trigger 2 is guaranteed, but on the other hand it is possible to pull trigger 2 so far out that the single-hand igniter handle can be effectively actuated. In this way it is possible to insert softer plastic in the area of the opening 29 to ensure secure support and on the other hand to secure pulling out optimally.

In the embodiment shown in FIG. 1 it is provided that the protective pipe 8 is designed as a thin-walled sleeve 40. The secure arrangement and support of the lid 28 on the one hand and of the plastic disc 36' is guaranteed, because, together with the shrink film or the shrink sleeve 34 respectively, covers 37, 37', 37" are provided at the corners. The compact unit is guaranteed in this way, whereby an identifier 44 is attached to the outer side 43 of the thin-walled sleeve 40 or of the protective pipe 8 respectively that refers to the length of the tube 3 supported in the protective pipe 8, and may also contain additional information.

Figure 2:
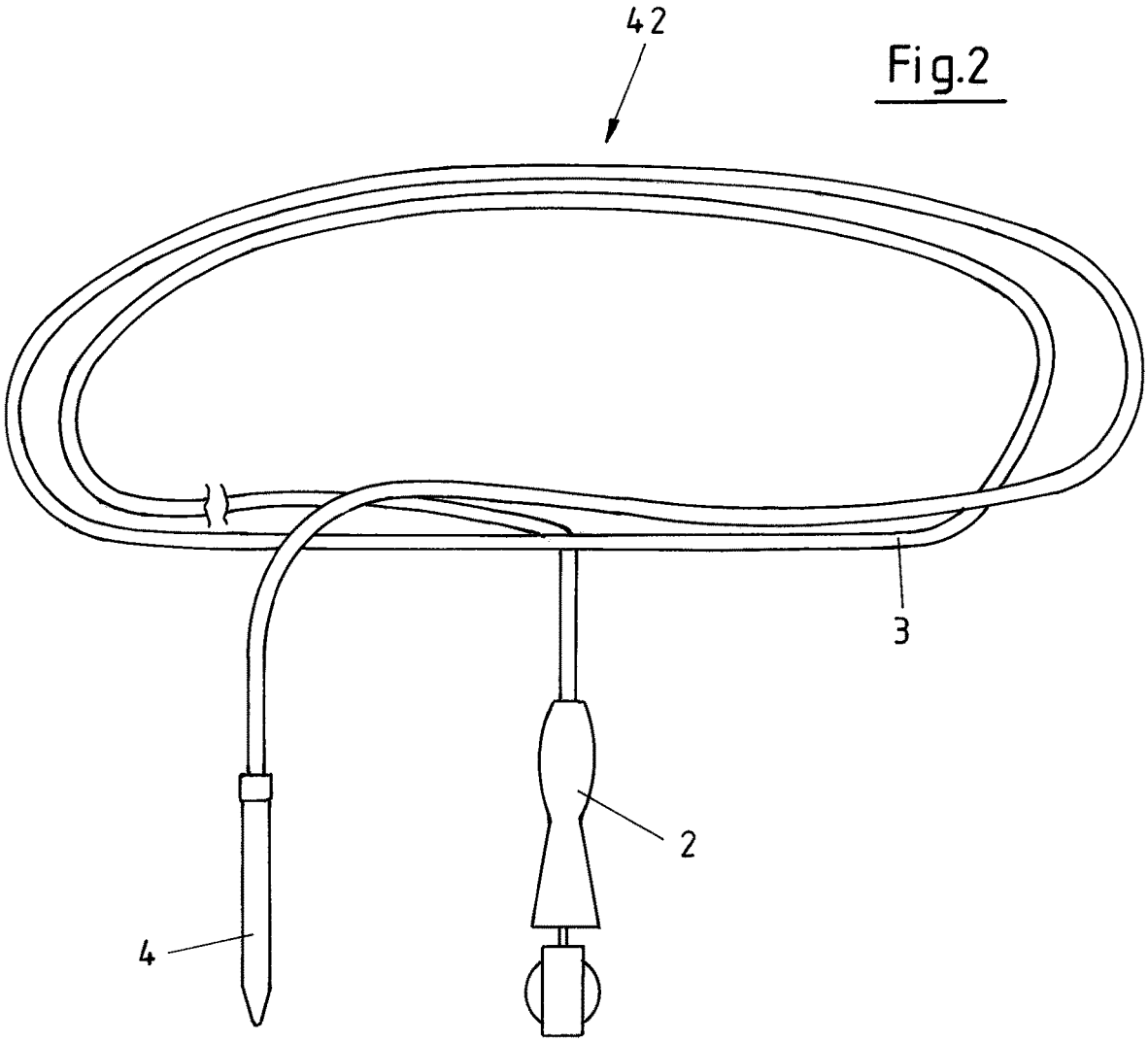
FIG. 2 shows an ignition device of a traditional type in a simplified representation and FIG. 3 shows an ignition device in a simplified design

FIG. 2 shows a previously usual embodiment of an ignition device 1 in which the trigger 2 is connected with the blasting cap 4 via a tube 3, that is, a hose with a given length. This tube 3 is designed as an extension hose 42 with a given length and as shown is stored in large loops and can therefore only be transported from there and stored with great effort.

Figure 3:
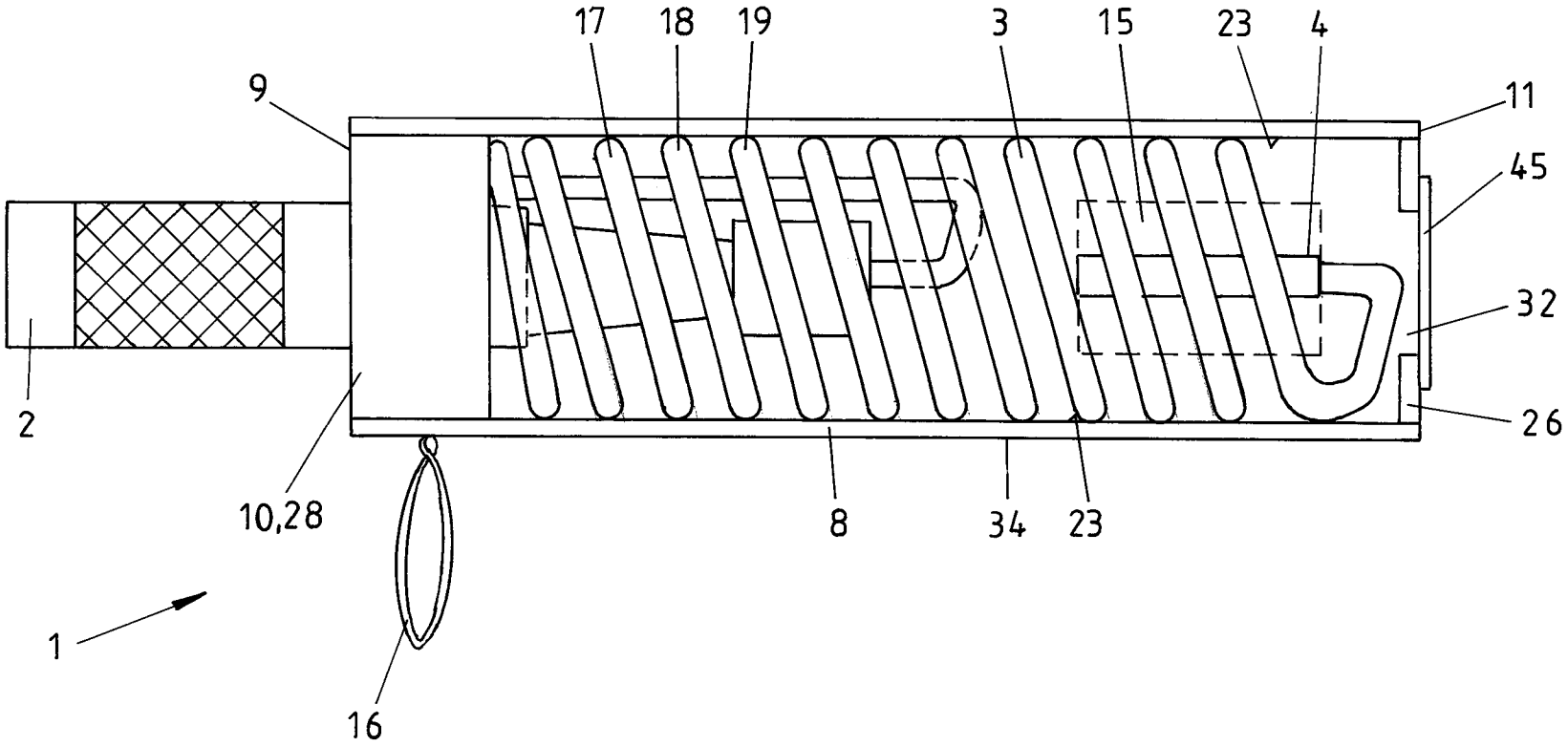

FIG. 3 shows a simplified embodiment of the ignition device 1, whereby blasting cap 4 and tube end 12 are both positioned completely in the protective pipe 8 and are therefore arranged with additional protection. The opening 32 is secured through a sealing cap 45, which is attached loosely, so that blasting cap 4 and tube end 12 cannot accidentally fall or slip out of the protective pipe 8. The individual coils 17, 18, 19 of the tube 3 are installed at a slant in the protective pipe 8, so that they incline in the direction of the end plate 10 and in addition are secured against falling out.

FIG. 4 shows a further embodiment of the invention that consists of the so-called EBBOS compact system with a tube/sleeve in which the EBBOS single-hand igniter is installed. The retaining ring 16 is shown at the side, through which the single-hand igniter can be unlocked, whereby an additional retaining pin 52 serves as an aid.

At the rear end 11, the blasting cap 4 can be pulled out of its transport position in the fragmentation protection sleeve 15, here in the form of a stable connection bushing 50, 50'. The (shock) tube 3 or thermotube coiled in the inside of the protective pipe/sleeve 8 can be pulled out at the rear end 11 with a slight pull.

The complete protective pipe 8 is enclosed in a shrink sleeve 34. The EBBOS single-hand igniter is held in the protective pipe by means of a locking device or a retaining ring 16. A groove 47 with groove opening 48 and groove end 49 presets the movement of the trigger 2. The two ends 9, 11 are each sealed by a plastic disc 25, 26 and a cover/sealing disc 13, so that the system is also suitable for underwater use (watertight).

All the designated characteristics, including those that can only be seen in the drawings, are regarded as significant for the invention individually and in combination.

The invention claimed is:

1. Ignition device comprising a mechanical trigger, a thermo or shock tube of variable length and a blasting cap for military or police use, wherein the blasting cap is arranged together with the trigger and the tube in a protective pipe, the protective pipe front end has end plates fixing the trigger and the protective pipe rear end has a sealing disc fixing the blasting cap and the tube end, wherein opposite ends of the protective pipe are sealed with a sealing ring and a lid, wherein the sealing ring and lid are designed as a plastic disc and a cover, wherein a shrink sleeve encloses the protective pipe and holds the sealing ring and lid in place; and whereby the tube, trigger, and blasting cap are stored entwined in the protective pipe and are configured to be pulled out of the protective pipe with the blasting cap.

2. Ignition device in accordance with claim 1, wherein the blasting cap is arranged in a fragmentation protection sleeve packed in the protective pipe.

3. Ignition device in accordance with claim 2, wherein the fragmentation protection sleeve is designed as stable support for the coils of the tube.

4. Ignition device in accordance with claim 1, wherein the protective pipe has an inner pipe holding the coils of the tube, whereby the tube is covered by an inner shrink sleeve towards an inner wall of the protective pipe.

5. Ignition device in accordance with claim 4, wherein the inner pipe is fitted at the ends with discs that secure the position of the tube in coils.

6. Ignition device in accordance with claim 5, wherein at the front end the protective pipe has the lid serving as an end plate having an opening for the trigger and at the rear end the sealing ring serving as a sealing disc having an opening that is shaped to facilitate insertion or pulling out of the inner pipe with coils.

7. Ignition device in accordance with claim 6, wherein the protective pipe is enclosed in the shrink sleeve.

8. Ignition device in accordance with claim 1, wherein the protective pipe is designed as a thin-walled sleeve with fixing covers, which are shaped to hold the lid at the front end and the sealing ring at the rear end securely.

9. Ignition device in accordance with claim 1, wherein the trigger has a shape that facilitates insertion and secure storage in the protective pipe.

10. Ignition device in accordance with claim 1, wherein an identifier showing the length of the tube is attached to the outside of the protective pipe.

11. Ignition device in accordance with claim 2, wherein the fragmentation protection sleeve is a connection bushing.

12. Ignition device in accordance with claim 11, wherein the connection bushing is designed to completely envelop the blasting cap.

13. Ignition device in accordance with claim 12, wherein the connection bushing is dimensioned to hold a second blasting cap as well.

* * * * *